US011525175B2

(12) United States Patent
Ding et al.

(10) Patent No.: US 11,525,175 B2
(45) Date of Patent: Dec. 13, 2022

(54) ALUMINUM ALLOY AND PREPARATION METHOD THEREOF

(71) Applicant: Guangdong Hoshion Industrial Aluminum Co., Ltd., Zhongshan (CN)

(72) Inventors: Xiaoli Ding, Zhongshan (CN); Jie Luo, Zhongshan (CN); Zhicheng Liu, Zhongshan (CN); Jianxiang Li, Zhongshan (CN); Zhongxin Wang, Zhongshan (CN); Qiang Ren, Zhongshan (CN)

(73) Assignee: Guangdong Hoshion Industrial Aluminum Co., Ltd., Zhongshan (CN)

( * ) Notice: Subject to any disclaimer, the term of this patent is extended or adjusted under 35 U.S.C. 154(b) by 379 days.

(21) Appl. No.: 16/736,209

(22) Filed: Jan. 7, 2020

(65) Prior Publication Data

US 2020/0362443 A1 Nov. 19, 2020

(30) Foreign Application Priority Data

May 14, 2019 (CN) ..... 201910399601.7

(51) Int. Cl.
*C22F 1/047* (2006.01)
*C22C 21/08* (2006.01)

(52) U.S. Cl.
CPC ..... *C22F 1/047* (2013.01); *C22C 21/08* (2013.01)

(58) Field of Classification Search
CPC ..... C22F 1/047; C22C 21/08
See application file for complete search history.

(56) References Cited

U.S. PATENT DOCUMENTS

2013/0255842 A1* 10/2013 Hori ..... C22F 1/05 148/417

OTHER PUBLICATIONS

Machine translation of CN109628804A (Year: 2019).*

* cited by examiner

*Primary Examiner* — Anthony J Zimmer
*Assistant Examiner* — Nazmun Nahar Shams
(74) *Attorney, Agent, or Firm* — Andrus Intellectual Property Law, LLP

(57) ABSTRACT

The present invention is applicable to the technical field of material processing and provides an aluminum alloy and a preparation method thereof. The preparation method of the aluminum alloy includes: weighing raw material components according to a preset weight ratio; melting the weighed raw materials, sequentially performing refinement, standing, slag removal, degassing and filtering, and then performing horizontal casting to obtain an aluminum alloy ingot; homogenizing the ingot; heating the ingot to 440-500° C., and placing the ingot in an extruder with an extrusion ratio of 30-100 for extrusion treatment; annealing the extruded blank; heating the annealed blank to 440-480° C. for deformation treatment, and controlling the deformation amount in the thickness direction to be 12%-28%; carrying out solution treatment on the deformed blank; and subjecting the blank after the solution treatment to artificial aging treatment.

7 Claims, 3 Drawing Sheets

ALUMINUM ALLOY AND PREPARATION METHOD THEREOF

CROSS-REFERENCE TO RELATED APPLICATION

The present application claims priority of Chinese Patent Application No. 201910399601.7, filed May 14, 2019, the content of which is incorporated herein by reference in its entirety.

TECHNICAL FIELD

The present invention belongs to the technical field of material processing, and particularly relates to an aluminum alloy and a preparation method thereof.

BACKGROUND

Aluminum alloy is a common material and is widely used in the manufacture of various commodities due to its light specific gravity, high specific strength, excellent anodic oxidation decorative effect, etc. Most alloy products can meet the requirements for structural strength and other properties, and their appearance is also an important factor that customers concern.

The appearance of the aluminum alloy product is related to the grain size inside the aluminum alloy. When the grain size inside the aluminum alloy is relatively large, after oxidation treatment, visible round, quasi-circular or snowflake-like grain boundaries can be formed on the surface of the product, which can form a special appearance. However, due to the limitation of the aluminum alloy preparation process, the strength of the aluminum alloy currently prepared is basically inversely proportional to the grain size inside the aluminum alloy, that is, a smaller grain size corresponds to greater strength. Therefore, in order to ensure the strength of the aluminum alloy, it is necessary to control the grain size inside the prepared aluminum alloy to be relatively small. However, the surface of the anodized aluminum alloy product is relatively monotonous without anything new to consumers.

It can be seen that the existing alloy preparation method cannot be used for preparing aluminum alloy materials with higher strength and larger grain sizes in inner and outer layers of the products, so that final aluminum alloy products have monotonous appearances without anything new to consumers.

SUMMARY

An objective of embodiments of the present invention is to provide a preparation method of an aluminum alloy, aiming to solve the technical problems that an existing aluminum alloy preparation method cannot be used for preparing aluminum alloy materials with higher strength and larger grain sizes in inner and outer layers of the products, so that final aluminum alloy products have monotonous appearances without anything new to consumers.

An embodiment of the present invention is implemented by a preparation method of an aluminum alloy, including the following steps:

weighing raw material components according to a preset weight ratio, where the raw material components include coarse ingot blanks or alloys of aluminum, silicon, magnesium, copper, manganese and titanium;

melting the weighed raw materials, sequentially performing refinement, standing, slag removal, degassing and filtering, and performing horizontal casting to obtain an aluminum alloy ingot;

homogenizing the aluminum alloy ingot;

heating the aluminum alloy ingot, and placing the aluminum alloy ingot in an extruder for extrusion treatment to obtain an aluminum alloy blank;

annealing the extruded blank at 400-500° C.;

heating the annealed blank to 440-480° C. for deformation treatment, and controlling the deformation amount in the thickness direction to be 12%-28%;

placing the deformed blank into a solid melting furnace heated to 540-560° C. and keeping the temperature for 2-12 h, and then taking out the blank and cooling the blank with normal temperature water; and subjecting the blank after the solution treatment to artificial aging treatment.

Another objective of embodiments of the present invention is to provide an aluminum alloy, where a size of recrystallized grains in the aluminum alloy is 500-3000 μm, and the yield strength of the aluminum alloy is not less than 280 MPa.

According to a preparation method of an aluminum alloy provided by an embodiment of the present invention, raw material components at a preset weight ratio are weighed first; the weighed raw materials are molten and sequentially subjected to refinement, standing, slag removal, degassing and filtering, and the molten raw materials are cast horizontally to obtain an aluminum alloy ingot; the obtained aluminum alloy ingot is homogenized first and then heated and placed in an extruder for extrusion treatment to obtain a blank, the extruded blank is annealed at 400-500° C., the annealed blank is heated to 440-480° C. for deformation treatment, and the deformation amount in the thickness direction is controlled to be 12%-28%, the deformed blank is placed into a solid melting furnace heated to 540-560° C. and the temperature is kept for 2-12 h, and then the blank is taken out and cooled with normal temperature water; and finally the blank after the solution treatment is subjected to artificial aging treatment. According to the preparation method of an aluminum alloy provided by the embodiment of the present invention, the size of recrystallized grains in the finally prepared aluminum alloy can be 500-3000 μm, and the yield strength is not less than 280 MPa. After anodizing treatment, the aluminum alloy surface shows visible grain boundaries with special-shaped stripes, so that the requirements for the strength of the aluminum alloy are met while the users' requirements for the appearance of the aluminum alloy are met.

DETAILED DESCRIPTION

Figure 1:
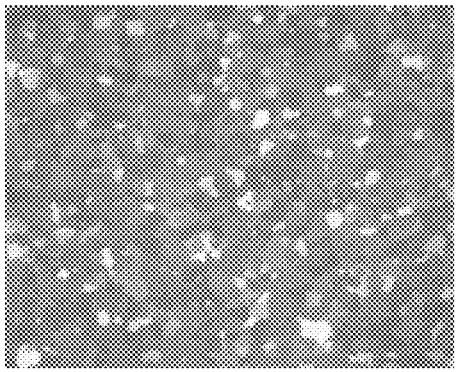
FIG. 1 is a schematic diagram of an internal grain structure of an aluminum alloy prepared in Embodiment 1 of the present invention.
Figure 2:
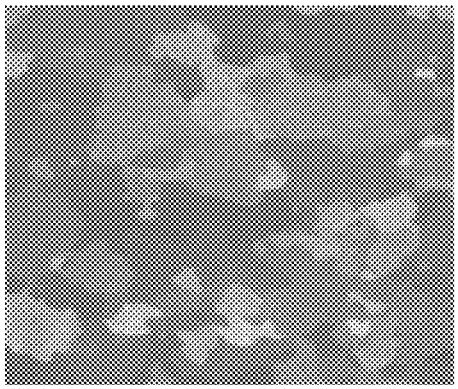
FIG. 2 is a schematic diagram of an internal grain structure of an aluminum alloy prepared in Embodiment 5 of the present invention.
Figure 3:
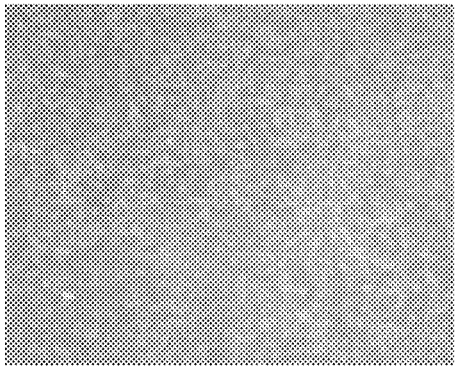
FIG. 3 is a schematic diagram of an internal grain structure of an aluminum alloy prepared in Embodiment 7 of the present invention.
Figure 4:
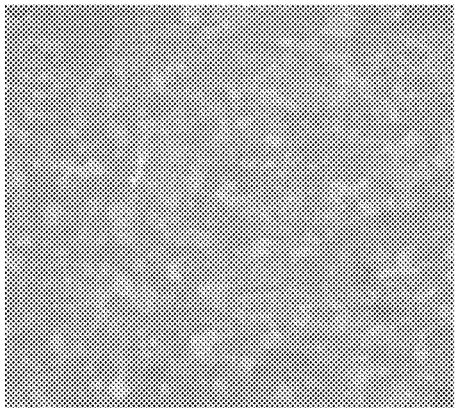
FIG. 4 is a schematic diagram of an internal grain structure of an aluminum alloy prepared in Embodiment 8 of the present invention.
Figure 5:
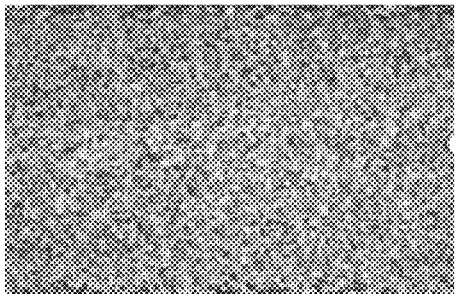
FIG. 5 is a schematic diagram of an internal grain structure of an aluminum alloy prepared in Comparative Example 1 of the present invention.
Figure 6:
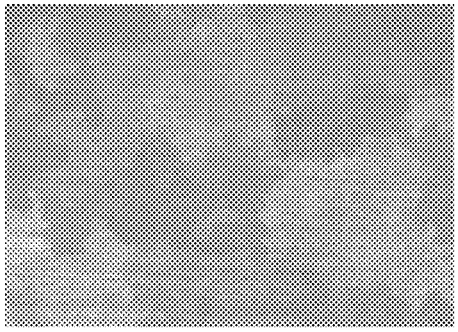
FIG. 6 is a schematic diagram of an internal grain structure of an aluminum alloy prepared in Comparative Example 2 of the present invention.
Figure 7:
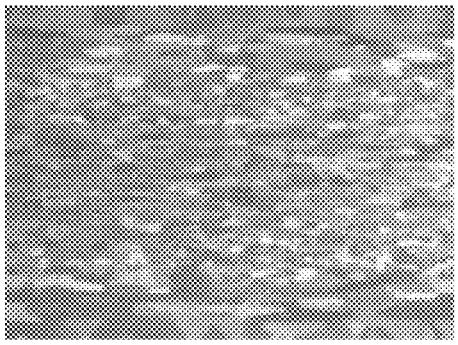
FIG. 7 is a schematic diagram of an internal grain structure of an aluminum alloy prepared in Comparative Example 5 of the present invention.

To make the objective, technical solutions and advantages of the present invention clearer, the following further describes the present invention in detail with reference to the accompanying drawings and embodiments. It should be understood that the specific embodiments described herein are merely illustrative of the present invention and are not intended to limit the present invention.

It can be understood that the terms "first", "second", and the like used in the present application may be used herein to describe various elements, but these elements are not limited by these terms unless otherwise specified. These terms are only used to distinguish one element from another. For example, a first xx script may be referred to as a second xx script and similarly, the second xx script may be referred to as the first xx script without departing from the scope of the present application.

It should be noted that the grain structure in the aluminum alloy is generally divided into two types: a recrystallized structure and an unrecrystallized structure, and the recrystallized structure can be divided into a recrystallized coarse grain structure and a recrystallized fine grain structure according to the sizes of the internal recrystallized grains. However, in the existing technical field of aluminum alloy manufacturing processes, an aluminum alloy with an unrecrystallized structure inside can be cast by process conditions such as controlling small deformation amount, controlling heat energy supply or adding a sufficient amount of alloy elements to increase the recrystallization temperature, or an aluminum alloy with a recrystallized fine grain structure inside can be cast by process conditions such as controlling a sufficient deformation amount or sufficient nucleation particles. However, one of the following difficulties still exists in manufacturing an aluminum alloy with a recrystallized coarse grain structure inside: (1) It is difficult to control process conditions and the forming rate is low. For the aluminum alloy with the recrystallized coarse grain structure inside, it is generally required to control process conditions between the process conditions for implementing foregoing unrecrystallized structure and the process conditions for implementing the recrystallized fine grain structure, and a process window is narrow. Even under the foregoing process conditions, it is very easy to produce a defective aluminum alloy with a mixed grain structure (that is, the unrecrystallized structure and the recrystallized structure coexist in the same product structure), with an extremely low success rate. (2) The strength of the aluminum alloy with the recrystallized coarse grain structure inside is low, which does not meet the requirements for the strength of the aluminum alloy. In order to solve the technical problems that the existing aluminum alloy with recrystallized coarse grains is difficult to prepare and has low strength, according to the present invention, through the matching of raw material components, homogenization treatment, extrusion treatment, annealing treatment, deformation treatment, solution treatment, artificial aging treatment are sequentially carried out, the specific process conditions of key steps such as the deformation treatment and the solution treatment are further limited, and the matching relationship between the raw material components and the process steps is utilized, so that the finally prepared aluminum alloy has a high success rate of the recrystallized coarse grain structure and has high strength.

A preparation method of an aluminum alloy provided by an embodiment of the present invention includes the following steps:

weighing raw material components according to a preset weight ratio, where the raw material components include coarse ingot blanks or alloys of aluminum, silicon, magnesium, copper, manganese and titanium;

weighing raw material components according to a preset weight ratio, where the raw material components include coarse ingot blanks or alloys of aluminum, silicon, magnesium, copper, manganese and titanium;

melting the weighed raw materials, sequentially performing refinement, standing, slag removal, degassing and filtering, and performing horizontal casting to obtain an aluminum alloy ingot;

homogenizing the aluminum alloy ingot;

heating the aluminum alloy ingot, and placing the aluminum alloy ingot in an extruder for extrusion treatment to obtain an aluminum alloy blank;

annealing the extruded blank at 400-500° C.;

heating the annealed blank to 440-480° C. for deformation treatment, and controlling the deformation amount in the thickness direction to be 12%-28%;

placing the deformed blank into a solid melting furnace heated to 540-560° C. and keeping the temperature for 2-12 h, and then taking out the blank and cooling the blank with normal temperature water; and subjecting the blank after the solution treatment to artificial aging treatment.

In the embodiment of the present invention, the step of melting the raw materials and sequentially performing refinement, standing, slag removal, degassing and filtering to obtain an aluminum alloy ingot is a conventional technical means well known to those skilled in the art, and is not explained herein.

In a preferred embodiment of the present invention, according to the preset weight ratio, the aluminum alloy includes 0.5-0.85% of silicon, 0.75-1.1% of magnesium, 0.10-0.85% of copper, no more than 0.20% of manganese, no more than 0.05% of titanium, and the balance being aluminum, where the amount of inevitable impurities should be less than 0.15%. In the embodiment of the present invention, by limiting the weight ratio of the foregoing metals, the strength of the prepared aluminum alloy can be effectively improved, the process window for preparing the recrystallized coarse grain structure can be widened, the success rate of the recrystallized coarse grain structure is improved, and the generation rate of defective products is reduced.

In a preferred embodiment of the present invention, the homogenization treatment condition is that the temperature is kept at 550-570° C. for 5-20 h. In the embodiment of the present invention, the homogenization treatment has better effect on improving the internal crystallization structure and strength performance of the aluminum alloy ingot.

In a preferred embodiment of the present invention, the extrusion treatment specifically includes the following steps: heating the aluminum alloy ingot to 440-500° C., and placing the aluminum alloy ingot into an extruder with an extrusion ratio of 30-100 for extrusion at an extrusion speed (namely the advancing speed of an extruder master cylinder) of 3.0-7.0 mm/s. In the embodiment of the present invention, the success rate of forming the recrystallized coarse grain structure can be effectively improved by further defining the temperature of the ingot in the extrusion process, the extrusion ratio of the extruder and the extrusion speed of the extruder.

In a preferred embodiment of the present invention, during the extrusion treatment process, the aluminum alloy ingot is dipped in water for cooling. In the embodiment of the present invention, the grain structure can be further improved by dipping in water for cooling in the extrusion process.

The annealing treatment is a conventional technical method to enhance alloy properties and improve the grain structure. However, different process conditions used in the annealing process lead to different properties of final products. In a preferred embodiment of the present invention, the annealing treatment conditions are that the annealing is carried out at 400-450° C., and the temperature is kept for 1-5 h. The embodiment of the present invention further defines the process conditions of the annealing process, which ensures that the annealed material has second phase particles with appropriate quantity and size, so that the second phase particles can be matched with other process flows. This reduces the difficulty of subsequent deformation treatment. The appropriate second phase particles are used as nucleation particles in the subsequent process, and the aluminum alloy prepared in the subsequent process is controlled to have a recrystallized coarse crystal structure, and the grain size is 500-3000 μm.

In the embodiment of the present invention, one of the objectives of the solution treatment is to dissolve strengthening phase particles in an alloy matrix to form a supersaturated solid solution, and the strength of the aluminum alloy can be improved in combination with the subsequent aging treatment. Another objective is to recrystallize the blank and obtain a recrystallized coarse grain structure with a grain size of 500-3000 μm. Since the deformation treatment enables the blank to have certain deformation energy, under the thermal activation condition in the solution heat treatment process, recrystallization nucleation can be formed and grain growth can be promoted. In order to obtain the appropriate grain size, the temperature and the heat preservation state of the solution treatment are crucial. For the aluminum alloy, too high solid solution temperature easily leads to overburning, which results in the problems of toughness reduction and too coarse grains; and too low temperature leads to the subsequent artificial aging treatment failing to meet the performance requirements or failing to reach the recrystallization temperature of the blank, resulting in the occurrence of the unrecrystallized structure or the mixed grain structure.

In a preferred embodiment of the present invention, before the step of placing the deformed blank into a solid melting furnace heated to 540-560° C. and keeping the temperature for 2-12 h, the deformed blank is placed into a solid melting furnace heated to 300-330° C. and the temperature is kept for 1-2 h. According to the process conditions of the solution treatment adopted by the embodiment of the present invention, the first heat preservation heat treatment can eliminate deformation stress and internal defects of the material at an appropriate temperature to provide conditions for a certain grain structure and strength, and the second heat preservation heat treatment can promote the growth of recrystallization nucleation, grain boundary migration and grain coarsening at an appropriate temperature. By setting up two-stage solution treatment, the aluminum alloy can be further controlled to form a recrystallized coarse grain structure with a suitable size.

In a preferred embodiment of the present invention, the artificial aging treatment condition is that the temperature is kept at 175-185° C. for 8-10 h.

In the embodiment of the present invention, through the matching relationship between the raw materials and each process flow and further defining the process conditions, the prepared aluminum alloy has a recrystallized coarse grain structure with a grain size of 500-3000 μm, high forming rate and high strength at the same time, and the yield strength is not less than 280 MPa.

In order to better embody the technical effect of the present invention, the following will be described with reference to specific embodiments, comparative examples and experimental effect diagrams.

Embodiment 1

A coarse ingot blank or alloy was weighed in such a weight ratio of metal elements that the coarse ingot blank or alloy included 0.65% of silicon, 0.90% of magnesium, 0.65% of copper, 0.10% of manganese, 0.03% of titanium and 97.67% of aluminum, where the content of inevitable impurities was lower than 0.15%.

The weighed raw materials were molten, sequentially subjected to refinement, standing, slag removal, degassing and filtering, and horizontally cast to obtain an aluminum alloy ingot.

The cast aluminum alloy ingot was homogenized at 570° C. for 5 h.

The homogenized aluminum alloy ingot was sawn into short ingots, and the short ingots were heated to 440° C. and placed in an extruder with an extrusion ratio of 50 for extrusion at an extrusion speed of 5.0 mm/s to obtain an aluminum alloy blank.

The extruded blank was annealed at 450° C., and the temperature was kept for 1 h.

The annealed blank was heated to 440° C. for deformation treatment, and the deformation amount in the thickness direction was controlled to be 12%.

After a solid melting furnace was heated to 540° C., the deformed blank was placed in the furnace, the temperature was kept for 12 h, and then normal temperature water was introduced for cooling.

The blank after the solution treatment was subjected to heat preservation treatment at 180° C. for 8 h.

Upon inspection, the aluminum alloy material prepared by the foregoing preparation method had a recrystallized coarse grain structure, and the sizes of grains measured in three perspectives were respectively as follows:

length direction: 700-2100 μm;

width direction: 600-2000 μm;

height direction: 800-2200 μm.

Upon inspection, the yield strength of the aluminum alloy material prepared by the preparation method was 305 MPa.

The grain size of the product was detected by using the standard method in GB/T3246.1 Inspection Method for Structure of Wrought Aluminum and Aluminum Alloy Products, and the mechanical properties of the product were tested by the standard method in GB/T 228 Metallic Materials-Tensile testing—Part 1: Method of Test at Room Temperature.

Methods for detecting the grain size of products and methods for testing mechanical properties of the products adopted in all subsequent embodiments and comparative examples were the same as above.

Embodiment 2

A coarse ingot blank or alloy was weighed in such a weight ratio of metal elements that the coarse ingot blank or alloy included 0.5% of silicon, 0.75% of magnesium, 0.85% of copper, 0.20% of manganese, 0.03% of titanium and 97.67% of aluminum, where the content of inevitable impurities was lower than 0.15%.

The weighed raw materials were molten, sequentially subjected to refinement, standing, slag removal, degassing and filtering, and horizontally cast to obtain an aluminum alloy ingot.

The cast aluminum alloy ingot was homogenized at 550° C. for 20 h.

The homogenized aluminum alloy ingot was heated to 480° C. and placed in an extruder with an extrusion ratio of 100 for extrusion at an extrusion speed of 3.0 mm/s to obtain an aluminum alloy blank.

The extruded blank was annealed at 400° C., and the temperature was kept for 5 h.

The annealed blank was heated to 480° C. for deformation treatment, and the deformation amount in the thickness direction was controlled to be 28%.

After a solid melting furnace was heated to 560° C., the deformed blank was placed in the furnace, the temperature was kept for 2 h, and then normal temperature water was introduced for cooling.

The blank after the solution treatment was subjected to heat preservation treatment at 175° C. for 8 h.

Upon inspection, the aluminum alloy material prepared by the foregoing preparation method had a recrystallized coarse grain structure, and the sizes of grains measured in three perspectives were respectively as follows:

length direction: 500-1500 μm;
width direction: 600-1400 μm;
height direction: 500-2100 μm.

Upon inspection, the yield strength of the aluminum alloy material prepared by the preparation method was 297 MPa.

Embodiment 3

A coarse ingot blank or alloy was weighed in such a weight ratio of metal elements that the coarse ingot blank or alloy included 0.85% of silicon, 1.1% of magnesium, 0.10% of copper, 0.05% of manganese, 0.05% of titanium and 97.85% of aluminum, where the content of inevitable impurities was lower than 0.15%.

The weighed raw materials were molten, sequentially subjected to refinement, standing, slag removal, degassing and filtering, and horizontally cast to obtain an aluminum alloy ingot.

The cast aluminum alloy ingot was homogenized at 560° C. for 8 h.

The homogenized aluminum alloy ingot was sawn into short ingots, and the short ingots were heated to 440° C. and placed in an extruder with an extrusion ratio of 30 for extrusion at an extrusion speed of 7 mm/s to obtain an aluminum alloy blank.

The extruded blank was annealed at 500° C., and the temperature was kept for 3 h.

The annealed blank was heated to 460° C. for deformation treatment, and the deformation amount in the thickness direction was controlled to be 20%.

After a solid melting furnace was heated to 550° C., the deformed blank was placed in the furnace, the temperature was kept for 7 h, and then normal temperature water was introduced for cooling.

The blank after the solution treatment was subjected to heat preservation treatment at 185° C. for 10 h.

Upon inspection, the aluminum alloy material prepared by the foregoing preparation method had a recrystallized coarse grain structure, and the sizes of grains measured in three perspectives were respectively as follows:

length direction: 500-1600 μm;
width direction: 600-2000 μm;
height direction: 600-1400 μm.

Upon inspection, the yield strength of the aluminum alloy material prepared by the preparation method was 295 MPa.

Embodiment 4

This embodiment has the same steps as Embodiment 1 only except that the step of weighing the raw material components specifically includes "weighing the raw material components in such a weight ratio that the aluminum alloy includes 1% of silicon, 1% of magnesium, 1% of copper, 0.3% of manganese, 0.1% of titanium and 96.6% of aluminum, where the content of inevitable impurities is lower than 0.15%".

Upon inspection, the aluminum alloy material prepared by the foregoing preparation method mostly had a recrystallized coarse grain structure, but a small amount of aluminum alloy material with a mixed grain structure appeared. The sizes of grains measured in three perspectives were respectively as follows:

length direction: 600-1500 μm;
width direction: 500-1800 μm;
height direction: 600-1600 μm.

Upon inspection, the yield strength of the aluminum alloy material prepared by the preparation method was 303 MPa.

Embodiment 5

This embodiment has the same steps as Embodiment 1 only except that the homogenization treatment specifically includes "homogenizing the cast aluminum alloy ingot at 500° C. for 5 h".

Upon inspection, the aluminum alloy material prepared by the foregoing preparation method had a recrystallized coarse grain structure. However, the size of the coarse grain structure was not uniform enough. The sizes of grains measured in three perspectives were respectively as follows:

length direction: 200-2800 μm;
width direction: 500-2500 μm;
height direction: 400-2700 μm.

Upon inspection, the yield strength of the aluminum alloy material prepared by the preparation method was 285 MPa.

Embodiment 6

This embodiment has the same steps as Embodiment 1 only except that the extrusion treatment step includes "sawing the homogenized aluminum alloy ingot into short ingots, heating the short ingots to 550° C. and placing the short ingots in an extruder with an extrusion ratio of 100 for extrusion at an extrusion speed of 10.0 mm/s to obtain an aluminum alloy blank".

Upon inspection, the aluminum alloy material prepared by the foregoing preparation method had a recrystallized coarse grain structure, but a small amount had a recrystallized fine grain structure. The sizes of grains measured in three perspectives were respectively as follows:

length direction: 400-1300 μm;

width direction: 500-1700 μm;

height direction: 400-1600 μm.

Upon inspection, the yield strength of the aluminum alloy material prepared by the preparation method was 309 MPa.

Embodiment 7

This embodiment has the same steps as Embodiment 1 only except that during the extrusion process, the aluminum alloy ingot was dipped in water for cooling.

Upon inspection, the aluminum alloy material prepared by the foregoing preparation method had a recrystallized coarse grain structure, and the internal recrystallized coarse grain structure was denser. The sizes of grains measured in three perspectives were respectively as follows:

length direction: 600-1200 μm;

width direction: 700-1200 μm;

height direction: 500-1000 μm.

Upon inspection, the yield strength of the aluminum alloy material prepared by the preparation method was 302 MPa.

Embodiment 8

This embodiment has the same steps as Embodiment 1 only except that before the step of placing the deformed blank into a solid melting furnace heated to 540-560° C. and keeping the temperature for 2-12 h, the method also includes: "placing the deformed blank into a solid melting furnace heated to 320° C. and keeping the temperature for 2 h".

Upon inspection, the aluminum alloy material prepared by the foregoing preparation method had a recrystallized coarse grain structure, crystal nuclei were fuller, and the crystallization structure was more uniform. The sizes of grains measured in three perspectives were respectively as follows:

length direction: 800-1300 μm;

width direction: 900-1300 μm;

height direction: 800-1400 μm.

Upon inspection, the yield strength of the aluminum alloy material prepared by the preparation method was 299 MPa.

Embodiment 9

This embodiment has the same steps as Embodiment 1 only except that the step of artificial aging treatment specifically includes "subjecting the blank after solution treatment to heat preservation treatment at 170° C. for 16 h".

Upon inspection, the aluminum alloy material prepared by the foregoing preparation method had a recrystallized coarse grain structure, and the sizes of grains measured in three perspectives were respectively as follows:

length direction: 700-1800 μm;

width direction: 600-2100 μm;

height direction: 800-2400 μm.

Upon inspection, the yield strength of the aluminum alloy material prepared by the preparation method was 296 MPa.

COMPARATIVE EXAMPLE 1

This comparative example has the same steps as Embodiment 1 only except that the step of weighing the raw material components specifically includes "weighing the raw material components in such a weight ratio that the aluminum alloy includes 0.65% of silicon, 0.9% of magnesium, 0.20% of iron, 0.65% of copper and 97.6% of aluminum, where the content of inevitable impurities is lower than 0.15%".

Upon inspection, the aluminum alloy material prepared by the foregoing preparation method had a recrystallized fine grain structure. The sizes of grains measured in three perspectives were smaller than 150 μm, and the yield strength was 310 MPa.

COMPARATIVE EXAMPLE 2

This comparative example has the same steps as Embodiment 1 only except that the step of annealing treatment specifically includes "annealing the extruded blank at 350° C. and keeping the temperature for 1 h".

Upon inspection, the aluminum alloy material prepared by the foregoing preparation method had a recrystallized coarse grain structure. The sizes of grains measured in three perspectives were greater than 3200 μm, and the yield strength was 260 MPa.

COMPARATIVE EXAMPLE 3

This comparative example has the same steps as Embodiment 1 only except that the step of deformation treatment specifically includes "heating the annealed blank to 400° C. for deformation treatment, and controlling the deformation amount in the thickness direction to be 7%".

Upon inspection, the aluminum alloy material prepared by the foregoing preparation method had a recrystallized coarse grain structure. However, the sizes of grains measured in three perspectives were greater than 5000 μm, and the yield strength was 250 MPa.

COMPARATIVE EXAMPLE 4

This comparative example has the same steps as Embodiment 1 only except that the step of solution treatment specifically includes "after a solid melting furnace is heated to 580° C., placing the deformed blank in the furnace, keeping the temperature for 15 h, and then immersing the blank in normal temperature water for cooling".

Upon inspection, the aluminum alloy material prepared by the foregoing preparation method had a recrystallized coarse grain structure, but part of the aluminum alloy was cracked. The sizes of grains measured in three perspectives were greater than 4000 μm, and the yield strength was 252 MPa.

COMPARATIVE EXAMPLE 5

This comparative example has the same steps as Embodiment 1 only except that the step of solution treatment specifically includes "after a solid melting furnace is heated to 500° C., placing the deformed blank in the furnace, keeping the temperature for 2 h, and then immersing the blank in normal temperature water for cooling".

Upon inspection, the aluminum alloy material prepared by the foregoing preparation method mostly had a recrystallized coarse grain structure. However, coarse grains and fine grains coexisted in part of the aluminum alloy material part, crystal nuclei had an irregular shape, and the crystallization structure was uneven. The sizes of grains measured in three perspectives were between 200 μm and 1000 μm, and the yield strength was 274 MPa.

The diagrams of internal crystallization structures of the embodiments and the comparative examples were obtained through a microscope, and several representative structural diagrams are shown, referring to FIGS. 1-7. It should be noted that the scale of magnification used in different drawings may be different.

In Embodiments 1 to 9, since the diagrams of internal crystallization structures of Embodiments 1, 2, 3, 4, 6 and 9 are relatively similar, the diagrams of the crystallization structures of all the foregoing embodiments are not shown herein one by one, but only Embodiment 1 is selected as the display diagram. Similarly, Comparative Examples 2, 3, and 4 also have similar internal crystal structure diagrams, but are only different in grain size. Here, the crystallization structure diagrams of all the foregoing comparative examples are not shown one by one, and only Comparative Example 2 is selected as the display diagram.

According to various embodiments and the accompanying drawings in the specification, it can be seen that:

(1) Compared with Embodiment 1, Comparative Examples 1, 2, 3, 4 and 5 respectively changed process conditions of raw material components and annealing treatment, process conditions of deformation treatment and process conditions of solution treatment, so that the finally prepared aluminum alloys did not simultaneously have an internal coarse grain structure and high higher yield strength. It can be seen that the process conditions of raw material components, annealing treatment, deformation treatment and solution treatment provided by the embodiments of the present invention are key factors for successfully preparing the aluminum alloy with both the internal coarse grain structure and higher yield strength performance. Through the cooperation of the above conditions and the like, the technical problem of conflict between the recrystallized coarse grain structure and strength performance in the prior art is solved, and the aluminum alloy with both the recrystallized coarse grain structure and high strength performance is provided.

(2) Compared with Embodiment 1, Embodiments 4 to 10 are all single factor experiments. By combining the changed conditions in each embodiment and the effects of the aluminum alloy products finally prepared, it can be seen that the aluminum alloy materials prepared can be further optimized by further defining the process conditions of homogenization treatment, extrusion treatment, annealing treatment, solution treatment or artificial aging treatment. For example, by combining experimental results of Embodiment 1 and Embodiment 4, it can be seen that by limiting the weight parts of each raw material component, the occurrence of aluminum alloy materials with a mixed grain structure can be effectively reduced. By combining experimental data of Embodiment 1 and Embodiment 5, it can be seen that the internal crystallization structure of the prepared aluminum alloy can be more uniform by defining the homogenization treatment conditions.

In addition, in order to further explain the advantages of the aluminum alloy with the recrystallized coarse grain structure, the aluminum alloy (with the recrystallized coarse grain structure) prepared in Embodiment 1 and the aluminum alloy (with the recrystallized fine grain structure) prepared in Comparative Example 1 were treated by the following process flow:

The foregoing aluminum alloys were treated with a commercially available SF-107B neutral degreasing agent (manufacturer: All Melux Fine Chemicals Co., Ltd.) at 40° C. for 5 min.

The treated aluminum alloys were washed once for 180 s at normal temperature.

The washed aluminum alloys were immersed in a pre-prepared grain boundary developing solution for soaking at 30° C. for 5 min, where the grain boundary developing solution was prepared by mixing acid liquor with water according to a volume ratio of 1:18, and the acid liquor was prepared by mixing hydrochloric acid with a volume concentration of 33%, nitric acid with a volume concentration of 62%, and hydrofluoric acid with a volume concentration of 42% according to a volume ratio of 1:1:1.

The treated aluminum alloys were washed once for 180 s at normal temperature.

The aluminum alloys washed again were anodized.

Figure 8:
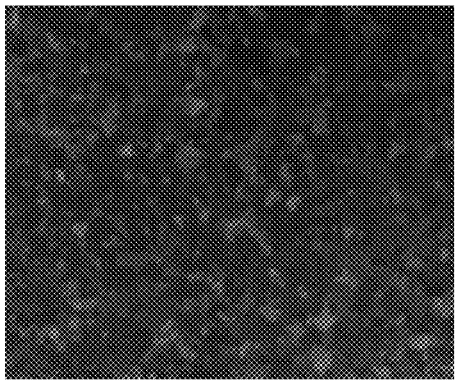
FIG. 8 is a schematic diagram of the surface appearance of a product obtained by anodizing treatment in Embodiment 1 of the present invention.
Figure 9:
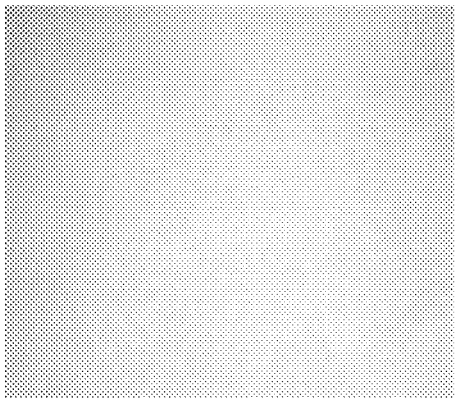
FIG. 9 is a schematic diagram of the surface appearance of a product obtained by anodizing treatment in Comparative Example 1 of the present invention.

The surfaces of the treated aluminum alloys of Embodiment 1 and Comparative Example 1 are shown in FIGS. 8 and 9, respectively. It can be seen that the surface of the aluminum alloy with the recrystallized coarse grain structure presented a visible special-shaped grain boundary, which is more attractive to the user's eyes and fully meets the user's requirements for the appearance of the aluminum alloy.

The foregoing embodiments are merely illustrative of several embodiments of the present invention, and the description thereof is more specific and detailed, but should not be construed as limiting the patent scope of the present invention. It should be noted that those of ordinary skill in the art can further make several variations and improvements without departing from the idea of the present invention. These all fall within the protection scope of the present invention. Therefore, the patent protection scope of the present invention should be subject to the appended claims.

The above are only the preferred embodiments of the present invention, and are not intended to limit the present invention. Any modifications, equivalent substitutions and improvements and the like made within the spirit and principles of the present invention should fall within the protection scope of the present invention.

The invention claimed is:

1. A preparation method of an aluminum alloy, comprising the following steps:

weighing raw material components according to a preset weight ratio, wherein the raw material components comprise coarse grained ingot blanks or alloys of aluminum, silicon, magnesium, copper, manganese and titanium;

melting the weighed raw materials, sequentially performing refinement, standing, slag removal, degassing and filtering, and performing horizontal casting to obtain an aluminum alloy ingot;

homogenizing the aluminum alloy ingot;

heating the aluminum alloy ingot to obtain a heated aluminum alloy ingot, placing the heated aluminum alloy ingot in an extruder, and performing an extrusion treatment on the heated aluminum alloy ingot to obtain an aluminum alloy blank;

annealing the aluminum alloy blank at 400-500° C. to obtain an annealed blank;

heating the annealed blank to 440-480° C. for deformation treatment to obtain a deformed blank, and controlling a deformation amount of the deformed blank in the thickness direction to be 12%-28% of the thickness of the annealed blank;

placing the deformed blank into a solid melting furnace heated to 300-330° C. and keeping the temperature for 1-2 h;

further heating the deformed blank in the solid melting furnace heated to 540-560° C. and keeping the temperature for 2-12 h, and then taking out the blank and cooling the blank with normal temperature water to obtain a cooled blank; and subjecting the cooled blank to an artificial aging treatment.

2. The preparation method of an aluminum alloy according to claim 1, wherein according to the preset weight ratio, the aluminum alloy comprises 0.5-0.85% of silicon, 0.75-1.1% of magnesium, 0.10-0.85% of copper, no more than 0.20% of manganese, no more than 0.05% of titanium, and the balance being aluminum.

3. The preparation method of an aluminum alloy according to claim 1, wherein the homogenization treatment condition is that the temperature is kept at 550-570° C. for 5-20 h.

4. The preparation method of an aluminum alloy according to claim 1, wherein the extrusion treatment specifically comprises the following steps: heating the aluminum alloy ingot to 440-500° C., and placing the aluminum alloy ingot into an extruder with an extrusion ratio of 30-100 for extrusion at an extrusion speed of 3.0-7.0 mm/s.

5. The preparation method of an aluminum alloy according to claim 1, wherein during the extrusion treatment process, the aluminum alloy ingot is dipped in water for cooling.

6. The preparation method of an aluminum alloy according to claim 1, wherein the annealing treatment conditions are that the annealing treatment is carried out at 400-450° C., and the temperature is kept for 1-5 h.

7. The preparation method of an aluminum alloy according to claim 1, wherein the artificial aging treatment condition is that the temperature is kept at 175-185° C. for 8-10 h.

* * * * *